US008661578B2

(12) United States Patent
Judge

(10) Patent No.: US 8,661,578 B2
(45) Date of Patent: Mar. 4, 2014

(54) PATIENT TRANSFER TUBE AND METHOD FOR MANUFACTURING THE SAME

(75) Inventor: John Farley Judge, Milwaukie, OR (US)

(73) Assignee: Wy'East Medical Corporation, Clackamas, OR (US)

( * ) Notice: Subject to any disclaimer, the term of this patent is extended or adjusted under 35 U.S.C. 154(b) by 251 days.

(21) Appl. No.: 12/586,019

(22) Filed: Sep. 15, 2009

(65) Prior Publication Data

US 2011/0061162 A1 Mar. 17, 2011

(51) Int. Cl.
*A61G 7/00* (2006.01)

(52) U.S. Cl.
USPC ..... 5/81.1 HS; 5/81.1 C; 5/81.1 R; 5/81.1 T

(58) Field of Classification Search
USPC ..... 5/81.1 R, 81.1 C, 81.1 HS, 486, 926, 943
See application file for complete search history.

(56) References Cited

U.S. PATENT DOCUMENTS

| | | | | |
|---|---|---|---|---|
| 5,005,232 | A | 4/1991 | Wright et al. | |
| 6,675,411 | B1 * | 1/2004 | Javier | 5/81.1 HS |
| 7,650,654 | B2 * | 1/2010 | Lambarth et al. | 5/81.1 HS |

OTHER PUBLICATIONS http://www.sandelmedical.com/Z-Slider-Patient-Transfer-Sheet.asp Publisher: Sandel, LLC; Title: Z-Slider(TM) Patient Transfer Sheet; Date of Publication: Unknown; Place of Publication: Internet; relevant pages: page at link indicated above, which includes links to "Request Product Literature" and "Watch a Demonstration Video.".

* cited by examiner

*Primary Examiner* — Nicholas Polito
(74) *Attorney, Agent, or Firm* — Portland Intellectual Property, LLC

(57) ABSTRACT

A patient transfer tube and method for manufacturing the same. In a polyethylene embodiment of the tube, there is at least a base layer that contains at least 85% by weight of polyetheylene, has an overall density of at least 0.935 g/cm$^3$, and has a thickness in the range of 33-64 microns.

21 Claims, 3 Drawing Sheets

PATIENT TRANSFER TUBE AND METHOD FOR MANUFACTURING THE SAME

FIELD OF THE INVENTION

The present invention relates to devices used in the medical field for laterally transferring patients between supporting surfaces, such as, e.g., a bed and a gurney. More particularly, the invention relates to a disposable transfer tube for this purpose and a method for manufacturing the same.

BACKGROUND

In the hospital, there is an ever-present need to move non or only partially ambulatory patients into and out of bed, onto or off of a gurney, or onto or off of an operating table, and to transfer the patient from one to another. These are all essentially "lateral" transfers, i.e., they do not typically involving changing the elevation of the patient's center of gravity. Hence, rolling and/or sliding operations are typically sufficient to provide for the transfer.

A "draw" or "slip" sheet is probably the most fundamental of the devices provided to serve this function. It is simply a planar sheet on which the patient lies, which is pulled across the bed/gurney/table surface (hereinafter "surface of repose"), taking the patient with it. The sheet may be provided with handles that facilitate grasping the sheet so that it can be more easily pulled. The sheets are typically formed of cloth.

The slip sheet slides on the surface of repose, and therefore resists the required pulling by friction, which is undesirable. It partially addresses this problem to provide slip sheets in the form of tubes ("transfer tube"). The transfer tube rolls as a flattened wheel, with inside surfaces of the tube sliding across one another.

An example of a transfer tube is described in U.S. Pat. No. 5,005,232. It contains a liquid lubricant sandwiched between inside surfaces of a pad that turns over upon itself while in use. The pad is formed of an elastomeric material, preferably polyurethane, which is flexible, puncture-resistant, resistant to germicides, and has a tensile strength that is greater than about 3,000 psi. The pad is sealed along its perimeter. This type of pad is expensive enough that it is re-used, and therefore cleaned after each use.

It has been recognized that transfer tubes that are open at each end, formed of a single sheet of thin plastic material, provide good functionality and are inexpensive enough to be considered disposable. An example is disclosed in Javier, U.S. Pat. No. 6,675,411, which is indicated as being preferably formed of polyethylene. The material generally has a low coefficient of friction, which is considered to be desirable so that the internal surfaces can easily slide over one another. An apparently corresponding product is marketed as the Z-Slider™ Patient Transfer Sheet, by Sandel Medical Industries, LLC of Chatsworth Calif. This product is effective and low in cost; however, it would be desirable to provide an improvement in performance without significantly increasing cost as provided herein.

SUMMARY

A patient transfer tube is disclosed herein. In one embodiment, the tube comprises a sheet of material having at least a base layer, the base layer containing at least 60% by weight of one or more polymers, which therefore may contain up to 40% of one or more other materials so as to define a mass fraction "f" of up to 0.4. The sheet provides for a combined flexural modulus E of greater than $6.4 \cdot 10^8$ Pascals. The sheet has a minimum thickness, measured in microns, defined by the relation $t_{min}=(5.2 \cdot 10^{13}/E)^{1/3}$ and a maximum thickness defined by the relation $t_{max}=((1.5 \cdot 10^{14}/E(1-f)))^{1/3}$.

In a more specific, polyethylene embodiment, the base layer contains at least 85% by weight of polyetheylene, has an overall density of at least 0.935 g/cm$^3$, and has a thickness in the range of 33-64 microns.

The following, preferred features may be provided separately or in any combination with either of the embodiments:

Preferably, the thickness of the sheet is substantially constant.

Preferably, the sheet contains an anti-static material providing for a surface resistivity, on an exterior surface of the tube, of not greater than $1 \cdot 10^{13}$ ohms/square. The anti-static material is preferably provided either as an additive included in the base layer, or as an additional layer of the sheet.

Preferably, the sheet includes at least one additional layer defining the interior surface that provides for a lower coefficient of friction than that of the corresponding surface of the base layer. More specifically, this lower coefficient of friction is preferably provided, at least in part, by a silicone lubricant.

Preferably, the exterior surface has a higher coefficient of friction than the interior surface. More specifically, the exterior surface preferably has a coefficient of friction that is higher on the exterior surface than on the interior surface by a factor of between 1.1 and 1.5.

In addition, methods for forming a patient transfer tube are disclosed. The methods include providing molten plastic resin as a step (a), after which there is a step (b) of forming the molten resin into a solidified sheet having a tubular configuration defining a tube, wherein the sheet thus formed has two sides corresponding, respectively, to an exterior and interior surface of the tube.

In one embodiment, the method includes a step, after step (b), of increasing the coefficient of friction of the side of the sheet defining said exterior surface. The additional step preferably includes exposing the exterior surface of the sheet to an air plasma.

In another embodiment, the method includes a step, after step (b), of depositing a pattern of a lubricant on the interior surface, wherein said pattern is distributed over a surface area that is at least 80% less than the total area of the interior surface. Preferably, the additional steps of the two different embodiments are both performed.

Moreover, with reference to the above prescription that anti-static material is preferably provided either as an additive included in the base layer, or as an additional layer of the sheet, if the anti-static material is provided as an additive, it is preferably mixed into the base layer when the base layer is in a molten state, whereas if the anti-static material is incorporated into an additional layer of the sheet, it is preferably applied to the sheet when the sheet is in a solidified state.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
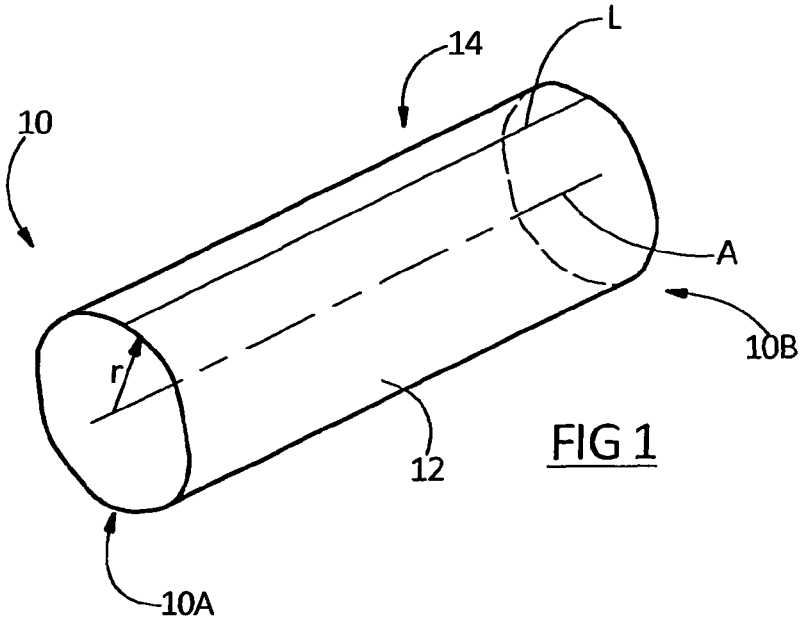
FIG. 1 is a pictorial view of a patient transfer tube according to the present invention.

FIG. 1 shows a patient transfer tube 10 according to the present invention. The uses of such tubes as a class are generally known and need not be described in detail to persons of ordinary skill. The '411 patent discloses a particular method of use; however, it may be noted that the use of a draw sheet as described therein is not required.

The tube 10 is formed of a relatively thin sheet 12 of a polymeric material that is configured as a tube as shown. The tube has two opposed open ends 10A and 10B, and defines a cylindrical axis "A." The tube is preferably formed by the "blown film extrusion" process, which is briefly to extrude the polymeric material in a molten state through a die defining an annular aperture, in the direction defined by the axis A. However, the tube could be formed in other ways, such as by joining two opposite ends of a rectangular sheet 12 along the line indicated as "L," and any other processing or manufacturing process having the appropriate capability may be used. Preferably, both ends of the tube are open, as shown in FIG. 1, for maximum tube effectiveness; however, either one or both ends of the tube could be closed and the transfer tube would still function.

Preferred dimensions of the tube 10 are about 38-40" long, or about 0.97-1.02 m, measured along the axis A, and 64-68" in circumference, or about 1.63-1.73 m, corresponding to a radius "r" of about 10.18"-10.82", or about 2.58-2.75 cm. The tube can be larger, either being longer or having a larger circumference, or both, as desired, and can be smaller, but to be useful for transferring an adult patient, the tube should be at least 30" long and 60" in circumference.

Figure 2:
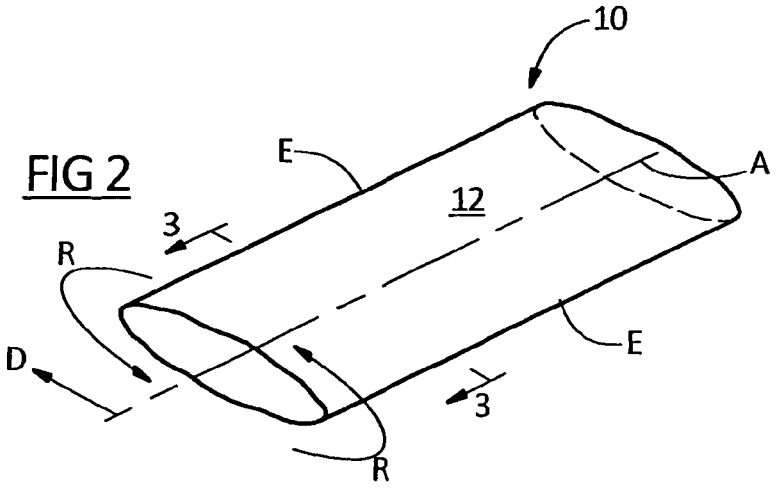
FIG. 2 is a pictorial view showing the tube of FIG. 1 in a relatively flattened condition.

FIG. 2 shows the tube 10 in a relatively flattened condition, in which left and right side edges "E" are defined.

Figure 3:
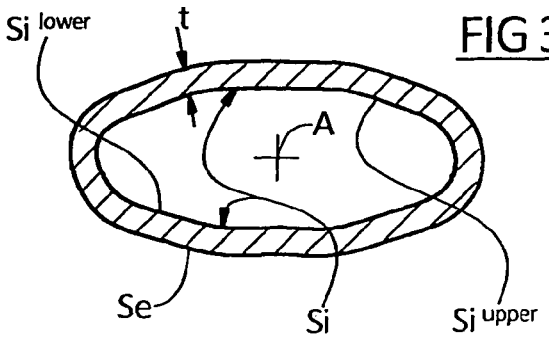
FIG. 3 is a cross-sectional view of the tube in the flattened condition shown in FIG. 2, with the thickness exaggerated for illustrative purposes, the view taken along a line 3-3 thereof.

FIG. 3 shows a cross-section of the tube in the configuration shown in FIG. 2, with a thickness "t" of the sheet exaggerated for illustrative purposes. The tube defines an interior surface "$S_i$," and an exterior "$S_e$." Although the interior surface $S_i$ is continuous, it is helpful to discern an upper portion "$S_i^{upper}$" and a lower portion "$S_i^{lower}$" The upper and lower portions slide across one another as the sheet of material 12 rolls about the cylindrical axis A such as indicated by the arrows "R" in FIG. 2, translating the axis A in the direction indicated as "D" as a result.

FIGS. 1-3 represent the tube 10 in a minimal configuration in which there is only a single, base layer of material in the sheet 12. It will be understood that additional layers may be present, such as by being co-extruded with or deposited on the surface of the base layer or any intervening layers and, as described below, at least one additional layer is considered preferable. Regardless of the number of layers, the interior and exterior surfaces $S_i$ and $S_e$ will by definition remain the outermost surfaces of the tube. Any additional layers are not shown in the Figures for the sake of clarity, and therefore the same reference designator (12) can be used to represent either the sheet 12 or the base layer, depending on context.

According to the invention, at least the base layer of the sheet 12 is formed of polyethylene. Polyethylene is a long-chain polymer whose material properties depend considerably on the amount of branching, which can be likened to the branches of a tree. Highly branched polymers cannot be packed as tightly as less highly branched polymers. Accordingly, polyethyelene can be provided in various densities. More particularly, the density of polyethylene can vary continuously between about 0.870 and 0.965 g/cm$^3$. Polyethylene at densities greater than about 0.950 g/cm$^3$ are considered "high density" (HDPE); polyethylene at densities between about 0.930 and 0.940 are considered "medium density" (MDPE); and polyethylene at densities less than about 0.930 are considered "low density" (LDPE); however, the dividing lines are somewhat arbitrary.

A primary objective of the invention is to provide for easier sliding of the interior surfaces $S_i^{upper}$ and $S_i^{lower}$ of the sheet 12 across one another. It may be expected that the way to do this is to lower the coefficient of friction (COF) on these surfaces, such as by applying a layer of a silicone polymer. However, the present inventor has recognized that adding such a layer to a tube like the tube 10 formed of LDPE does not significantly increase the ease with which the interior surfaces slide.

This observation has led to a recognition that COF is not a result determinative factor in facilitating the sliding of the interior surfaces $S_i$. Rather, the inventor has identified "elastic stiffness" as at least one primary factor responsible for providing this result. The tube 12 is utilized on a highly compliant supporting surface, such as a bed. If the sheet is itself compliant, it tends to conform, by deformation, to the un-even support provided by the supporting surface, thus becoming less planar and essentially anchoring itself at (by sinking down into) undulations in the supporting surface, and so acts as though it has an increased COF.

Figure 4:
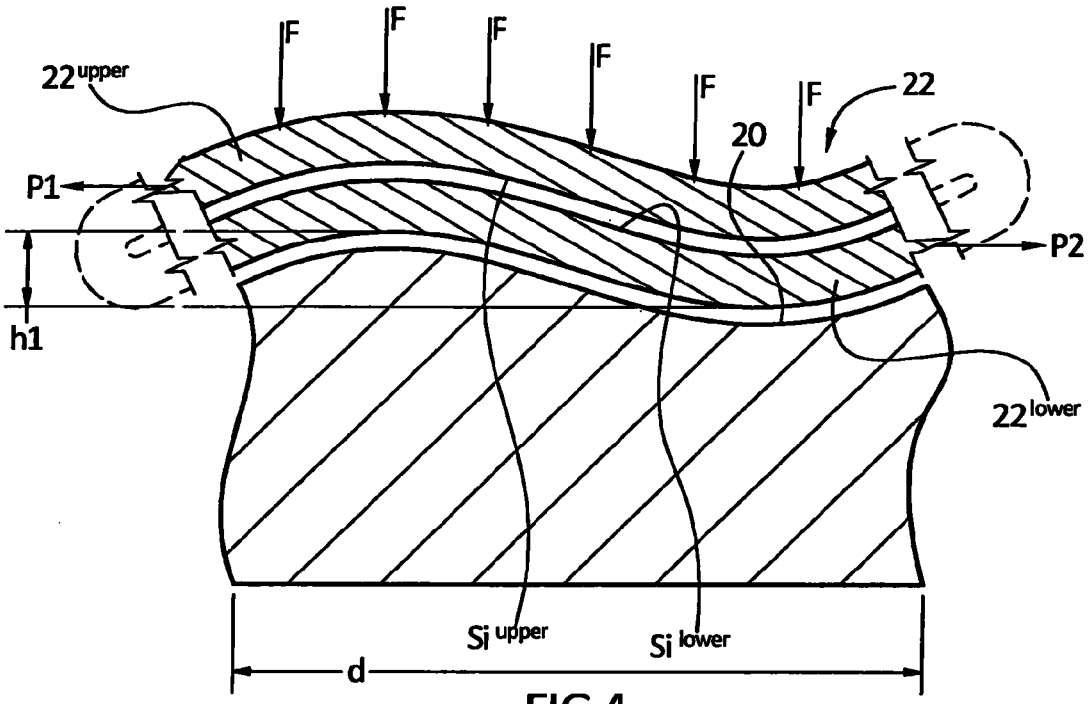
FIG. 4 is a cross-sectional view of a relatively small portion of a first tube formed of a relatively compliant material, shown on an non-planar supporting surface such as a bed or gurney.
Figure 5:
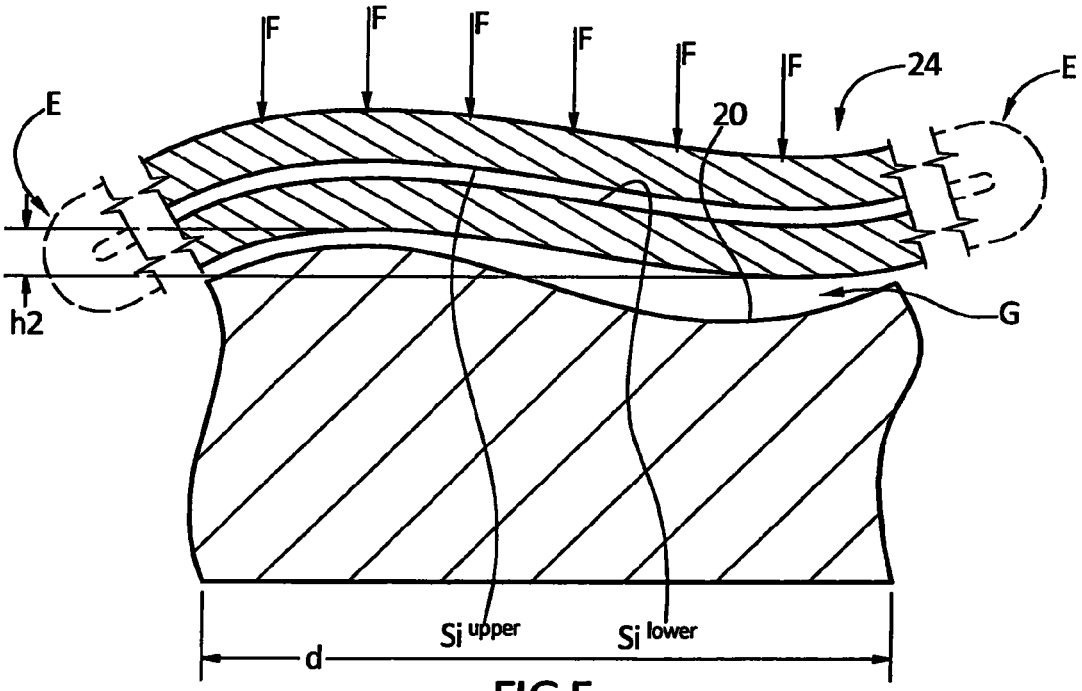
FIG. 5 is a cross-sectional view showing a second tube like that of FIG. 4 except formed of a relatively stiff material, under the same conditions.

The idea is illustrated by comparison of FIGS. 4 and 5. In FIG. 4, a small section (the distance "d" indicated is about ½") of a compliant supporting surface 20 supports a correspondingly small portion of a sheet 22 to which downward forces "F" are applied, such as might be applied by the weight of a patient.

The sheet 22 deforms an amount "$h_1$" and pulling on upper and lower portions $\mathbf{22}^{upper}$ and $\mathbf{22}^{lower}$ in the directions defined by the couple $P_1$-$P_2$ as required to cause the upper and lower interior surfaces $S_i^{upper}$ and $S_i^{upper}$ to slide across one another requires overcoming the "step" defined by the deformation $h_1$. This requires deforming the sheet material as well as sliding it. Reducing the COF along the interior surfaces alleviates the drag caused the latter, but not the former.

Compare FIG. 4 with FIG. 5, in which a sheet 24 has a higher elastic stiffness than the sheet 22, and therefore conforms less to the undulations defined by the support surface 20. Because of its elastic, i.e. recoverable, stiffness, it tends to support itself over small gaps, such as that at "G." This reduces the step height to "$h_2$." Less deformation is required to slide the interior surfaces $S_i^{upper}$ and $S_i^{upper}$ across one another, and this has been observed to dramatically reduce the effort required to cause this sliding, even though the COF remains the same.

It is therefore recognized that, when the supporting surface for the sheet is not both rigid and flat, bulk properties of the sheet such as elastic stiffness, as opposed to surface properties such as COF, become more important to reducing the "friction" or drag associated with sliding the sheet.

It is further recognized that the flexural modulus, which is the material property intrinsic to elastic stiffness, is significantly greater for polyethylene of higher density. It is believed that this results from a higher degree of crystallinity resulting from more densely packed polyethylene molecules; however, there may other mechanisms involved.

Based on these insights, the base layer of the sheet 12 is preferably formed of a polymeric material having a high flexural modulus. The polymeric material is preferably polyethyelene, specifically HDPE, but it may be any other plastic material.

For reference, the flexural modulus is analogous to the spring constant of a spring, and defines the force required to elastically deform the material, i.e., to deform the material reversibly, before plastic (permanent) deformation sets in. This may be contrasted with the strength of the material, which is defined by the force required to break it, which occurs well after plastic deformation has occurred.

The base layer preferably has a substantially constant thickness "t" (FIG. 3), i.e., a thickness that varies no more than +/−1.0 mil, or about +/−25 microns. Of course, making the sheet thinner reduces material costs; however, the thickness of the sheet should be sufficient to provide the structural rigidity described above. So the thickness should not be too small. On the other hand, while higher structural rigidity assists the sliding described above in connection with FIGS. 4 and 5, it makes it more difficult to turn the corner at the edges E (FIG. 5).

Based on a sheet 12 having a single base layer of HDPE of density equal to 0.949 g/cm$^3$, the inventor has determined an optimum range of thickness based on a balance of these structural factors, of between 1.4 and 2.0 mils, or approximately 36-52 microns, with 1.8 mils, or approximately 46 microns, being the optimum (corresponding to an optimum range of 1.75-1.85 mils, or approximately 45-48 microns). The stiffness "S" (per unit width) corresponding to the thickness "t" can generally be calculated as:

$$S=(E\cdot t^3)/12 \qquad \text{Equation 1}$$

where E is the flexural modulus. Solving equation 1 for the minimum and maximum thicknesses noted above, in view of the flexural modulus for HDPE of the given density (approximately 161,000 psi), and accounting for the possibility of the presence of fraction "f" by weight of any filler material, yields:

$$t_{min}=(12\cdot S_{min}/E)^{1/3}; \text{ and}$$

$$t_{max}=(12\cdot S_{max}/(E\cdot(1-f)))^{1/3}. \qquad \text{Equations 2}$$

Solving Equation 1 for $S_{min}$ and $S_{max}$ given $t_{min}$ and $t_{max}$, and substituting into Equations 2, yields:

$$t_{min}=((5.2\cdot 10^{13})/E)^{1/3}; \text{ and}$$

$$t_{max}=((1.5\cdot 10^{14})/(E\cdot(1-f)))^{1/3}. \qquad \text{Equations 3}$$

In Equations 3, E is the flexural modulus of the material, and therefore Equations 3 apply for any material. It is preferable that the mass fraction "f" is not greater than 0.40 (40%). Note that the minimum, minimum thickness is achieved without any filler (f=0). The combined flexural modulus of the base layer of the sheet 12 is preferably greater than $6.4\cdot 10^8$ Pascals, which corresponds to polyethylene of density equal to 0.935 g/cm$^3$.

In a preferred embodiment in which the sheet is formed of polyethylene, the base layer preferably contains at least 85% by weight of polyetheylene, has an overall density of at least 0.935 g/cm$^3$, and has a thickness in the range of 1.3-2.5 mils, or about 33-64 microns.

The sheet 12 may and preferably does have additional layers, and the additional layers may incorporate or consist of different materials. For example, it is common to "co-extrude" a number of different plastic materials to better tailor the properties of blown plastic film. Any such layers may be incorporated in the sheet 12 as desired, and as long as such additional layers do not negatively impact the structural quality defined by the base sheet with regard to the stiffness considerations discussed above, it may be preferable to do so.

It should be understood that the aforedescribed exterior and interior surfaces $S_e$ and $S_i$ of the sheet 12 are defined by the outermost layers. If only the base layer is provided, then the interior and exterior surfaces of the sheet are the same as the interior and exterior surfaces of the base layer. In any event, the interior and exterior surfaces of the sheet are the same as the interior and exterior surfaces of the tube.

Preferably, at least one additional layer is provided on the sheet 12. In general, additional layers may be applied to a base layer that is solidified, such as by being topically applied or otherwise deposited, or to the base layer when it is in a molten state, such as co-extrusion.

Preferably, the additional layer is a silicone lubricant coating, deposited on the surface of the base layer corresponding to the interior surface of the tube. This is for the purpose of providing a lower COF at the interior surface than would otherwise be provided by the base layer.

Figure 6:
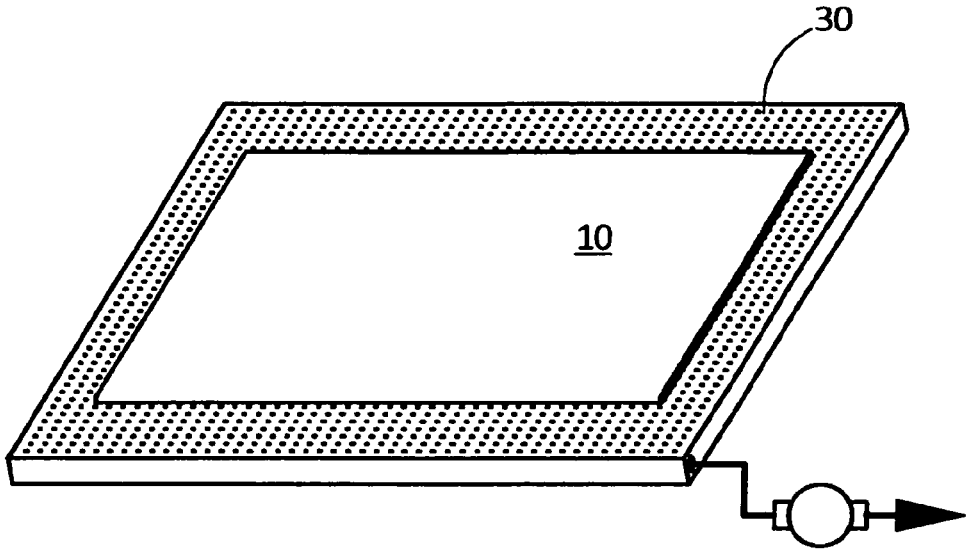
FIG. 6 is a pictorial view of a patient transfer tube according to the invention disposed on a vacuum table, as part of a process for applying a lubricant according to the invention.
Figure 7:
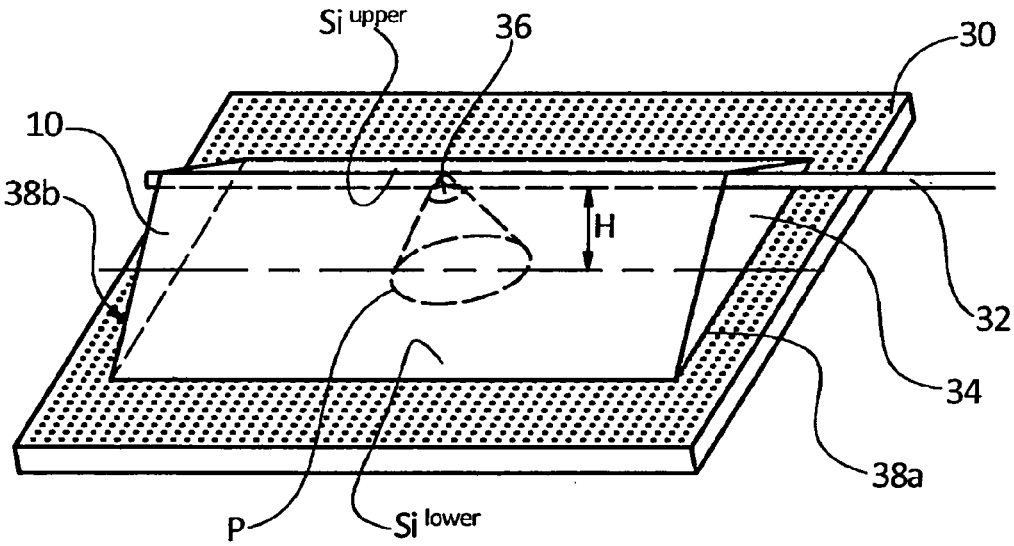
FIG. 7 is a pictorial view of a the patient transfer tube of FIG. 6 being manipulated so as to apply the lubricant.

A preferred method for applying the silicone is by an atomized spray of the silicone lubricant in liquid form. Referring to FIG. 6, the tube 10 is first laid flat on vacuum table 30. Turning to FIG. 7, a mechanism 32 is inserted between the interior surfaces $S_i^{lower}$ and $S_i^{upper}$, which separates the upper surface from the lower surface to form an inverted "V" shaped aperture 34. Other mechanical mechanisms, such as may use a vacuum to grab hold of the exterior surface, could be used.

The height "H" of the aperture is typically, roughly, 45 cm. An atomizing spray nozzle 36 is introduced into the tube, through the aperture 34, to a point roughly mid-way between the two ends of the tube, referenced as 38*a* and 38*b*, at approximately the height, above the lower surface $S_i^{lower}$, of the vertex of the inverted "V" shaped upper surface. The spray nozzle points downwardly, toward the lower surface. The lubricant is forced under pressure through the nozzle 36 and exits the nozzle in the shape of cone, so as to deposit a quantity of lubricant on the lower surface in a pattern "P" in the shape of the perimeter of a circle. Preferably, the dispensed quantity is about 0.055-0.058 grams for a tube 10 of the dimensions indicated above. The diameter of the circle thus formed is preferably about 30 cm, and the surface area covered by the pattern is significantly less than 80% of the total interior surface area. The lubricant is spread about the interior of the tube during use.

However, any known method for applying the silicone lubricant, which can be in a liquid or dry form, could be used.

Alternatively, a lubricant could be provided in the base layer, mixed in as all or part of the aforementioned non-structural additives. As another alternative, another layer of a plastic having a relatively high lubricity may be co-extruded with the base layer.

As still another example of an additional layer, a topical anti-static coating may be applied to the base layer of the sheet 12. Polymers generally have poor static dissipation performance, and it is important in the hospital environment to minimize high voltage electrostatic discharges, both to protect critical electronic equipment and to decrease the hazard of fire. More particularly, the National Fire Prevention Agency, in NFPA 099, specifies for hospital use of the sheet 12 in the U.S., a surface resistivity of at most $1\cdot10^{11}$ ohms/square, measured according to a standard set forth by the American Society for Testing and Materials (ASTM) as D257. Since this standard may be stricter than is necessary for world-wide use of the tube 10, it is considered sufficient to specify, as being preferable, a surface resistivity of no more than $1\cdot10^{13}$ ohms/square for the tube 10. Since it is notoriously difficult to repeatably and therefore reliably measure surface resistivities greater than $10^8$ ohms/square, surface resistivities are preferably measured for purposes herein using the method known in the art as the "Alternating Polarity Method," using the commercially available "Model 65 High Resistivity Measurement Package" as provided by Keithly Instruments of Cleveland Ohio, USA. The package implements a method described in Keithly White Paper #108, Daire, A., "Improving the Repeatability of Ultra-High Resistance and Resistivity Measurements," which is incorporated by reference herein in its entirety.

In the form of a topical anti-static coating, the anti-static material is typically quaternary ammonium salts, in a water base. It has been found to be effective to apply the coating only on that side of the sheet 12 that corresponds to the exterior surface $S_e$ of the tube 10; however, it is possible to apply an anti-static coating on any surface on which it is considered desirable.

As an alternative anti-static treatment, an anti-static "additive" may be mixed with the molten resin(s) of which one or more of the layers of the sheet 12 is formed, to thereby become incorporated or embedded therein. A typical such additive used in blown film polyethylene sheet is known in the art as ANTISTAT 1004T, available from PolyChem Alloy®, Inc. of Lenoir, N.C. The present inventor has determined, however, that such products tend to decrease the desired elastic stiffness. It is believed that this is due both to the effect of the "active ingredient" in the formulation, which serves the function of providing for the required electrical conduction, as well as to the effect of the "carrier resin" which is LDPE or LLDPE (linear low density polyethylene) used for carrying and dispersing the active ingredient.

To correct for these tendencies, the carrier can either be omitted, or replaced with a carrier containing a combination of one or more polyethylenes such that the combined average densities of the polyethylenes in the carrier is greater than or equal to 0.935 g/cm$^3$.

It is further recognized that it is desirable to ensure that the exterior surface of the tube has a higher coefficient of friction than the interior surface, so that the interior surface slides preferentially to the exterior surface, to encourage the tube to roll rather than slide across the bed or gurney. However, the COF should not be so high that it objectionably interferes with the capability to slide the (collapsed) tube 10 out from under a patient at such time that it should be removed.

In view of these considerations the invention preferably provides for treating the exterior surface $S_e$ to modify the COF of the exterior surface $S_e$ so that it is greater than that of the interior surface $S_i$ by a factor of between about 1.1 and 1.5, and most preferably 1.2-1.3.

A desirable treatment for this purpose is that known as "air plasma" or "corona discharge." By this process, which is known to persons of ordinary skill in the manufacture of blown films, a high voltage is briefly applied, at high frequency, across an air gap onto the surface of the solidified sheet 12. As applied to the exterior surface $S_e$, the process preferentially treats the exterior surface, and within the thickness range indicated above, does not significantly affect the COF of the base layer at the interior surface $S_i$.

The amount of treatment, defined by the energy applied per unit area, is varied according to the invention to result in the aforementioned factor as a differential between the COF at the interior surface $S_i$, and that at the exterior surface. Accordingly, the amount will be less if the interior surface is defined by a silicone polymer layer as has been indicated to be preferable, which has a lower COF, than if the interior surface is defined by the base layer. It may also be the case that no such treatment is necessary, given the natural differential in the coefficients of friction of the two outermost surfaces.

The corona discharge surface treatment is typically applied to the sheet 12 prior to the time it is configured as a tube, however, this is not essential.

Alternatively, any other method could be used to increase the COF of the exterior surface, such as by the addition of a tackifier.

It is to be understood that, while specific patient transfer tubes and methods for manufacturing the same have been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A patient transfer tube, comprising a sheet of material having at least a base layer, said base layer containing at least 60% by weight of one or more polymers, and which therefore may contain up to 40% of one or more other materials so as to define a mass fraction "f" of up to 0.4, providing a combined flexural modulus E of greater than $6.4\cdot10^8$ Pascals, said sheet having a minimum thickness, measured in microns, defined by the relation $t_{min}=(5.2\cdot10^{13}/E)^{1/3}$ and a maximum thickness defined by the relation $t_{max}=((1.5\cdot10^{14}/E(1-f)))^{1/3}$.

2. The patient transfer tube of claim 1, said sheet having two sides corresponding, respectively, to an exterior and interior surface of the tube, wherein said exterior surface has a surface resistivity of not greater than $1\cdot10^{13}$ ohms/square, wherein said surface resistivity is achieved, at least in part, as a result of the inclusion, in the base layer, of an anti-static additive.

3. The patient transfer tube of claim 1, said sheet having two sides corresponding, respectively, to an exterior and interior surface of the tube, wherein said exterior surface has a surface resistivity of not greater than $1\cdot10^{13}$ ohms/square, wherein said surface resistivity is achieved, at least in part, as a result of the addition, to the sheet, of a layer of an anti-static material.

4. The patient transfer tube of claim 3, said sheet having at least one additional layer defining said interior surface that provides for a lower coefficient of friction than that of the corresponding surface of said base layer.

5. The patient transfer tube of claim 4, wherein said additional layer comprises a silicone lubricant.

6. The patient transfer tube of claim 2, said sheet having two sides corresponding, respectively, to an exterior and interior surface of the tube, said sheet having at least one additional layer defining said interior surface that provides for a lower coefficient of friction than that of the corresponding surface of said base layer.

7. The patient transfer tube of claim 6, wherein said additional layer comprises a silicone lubricant.

8. The patient transfer tube of claim 7, wherein said exterior surface has a higher coefficient of friction than said interior surface.

9. The patient transfer tube of claim 8, wherein said exterior surface has a higher coefficient of friction than said interior surface by a factor of between 1.1 and 1.5.

10. The patient transfer tube of claim 6, wherein said exterior surface has a higher coefficient of friction than said interior surface.

11. The patient transfer tube of claim 10, wherein said exterior surface has a higher coefficient of friction than said interior surface by a factor of between 1.1 and 1.5.

12. The patient transfer tube of claim 5, wherein said exterior surface has a higher coefficient of friction than said interior surface.

13. The patient transfer tube of claim 12, wherein said exterior surface has a higher coefficient of friction than said interior surface by a factor of between 1.1 and 1.5.

14. The patient transfer tube of claim 4, wherein said exterior surface has a higher coefficient of friction than said interior surface.

15. The patient transfer tube of claim 14, wherein said exterior surface has a higher coefficient of friction than said interior surface by a factor of between 1.1 and 1.5.

16. The patient transfer tube of claim 3, wherein said exterior surface has a higher coefficient of friction than said interior surface.

17. The patient transfer tube of claim 16, wherein said exterior surface has a higher coefficient of friction than said interior surface by a factor of between 1.1 and 1.5.

18. The patient transfer tube of claim 2, said sheet having two sides corresponding, respectively, to an exterior and interior surface of the tube, wherein said exterior surface has a higher coefficient of friction than said interior surface.

19. The patient transfer tube of claim 18, wherein said exterior surface has a higher coefficient of friction than said interior surface by a factor of between 1.1 and 1.5.

20. The patient transfer tube of claim 1, said sheet having two sides corresponding, respectively, to an exterior and interior surface of the tube, wherein said exterior surface has a higher coefficient of friction than said interior surface.

21. The patient transfer tube of claim 20, wherein said exterior surface has a higher coefficient of friction than said interior surface by a factor of between 1.1 and 1.5.

* * * * *